US008458894B2

(12) United States Patent
Chen et al.

(10) Patent No.: US 8,458,894 B2
(45) Date of Patent: Jun. 11, 2013

(54) METHOD FOR MAKING A POSITIVE TEMPERATURE COEFFICIENT DEVICE

(75) Inventors: Jack Jih-Sang Chen, Taipei (TW); Chi-Hao Gu, Taipei (TW)

(73) Assignee: Fuzetec Technology Co., Ltd., Taipei County (TW)

( * ) Notice: Subject to any disclaimer, the term of this patent is extended or adjusted under 35 U.S.C. 154(b) by 502 days.

(21) Appl. No.: 12/472,001

(22) Filed: May 26, 2009

(65) Prior Publication Data

US 2010/0299919 A1 Dec. 2, 2010

(51) Int. Cl.
*H01C 7/02* (2006.01)
*H01C 7/04* (2006.01)

(52) U.S. Cl.
USPC ..... 29/612; 29/621; 29/846; 29/874

(58) Field of Classification Search
USPC .... 29/612, 610.1, 621, 846, 854, 874; 338/22 SD, 22 R, 51, 327, 328; 361/58, 106
See application file for complete search history.

(56) References Cited

U.S. PATENT DOCUMENTS 5,378,407 A * 1/1995 Chandler et al. ..... 252/513
5,801,612 A * 9/1998 Chandler et al. ..... 338/22 R
2004/0041683 A1* 3/2004 Tosaka et al. ..... 338/22 R

* cited by examiner

*Primary Examiner* — Thiem Phan
(74) *Attorney, Agent, or Firm* — Foley & Lardner LLP

(57) ABSTRACT

A method for making a positive temperature coefficient device includes: (a) forming a crosslinkable preform of a positive temperature coefficient polymer composition containing a polymer system and a conductive filler; (b) attaching a pair of electrodes to the preform; (c) soldering a pair of conductive leads to the electrodes using a lead-free solder paste having a melting point greater than 210° C.; and (d) crosslinking the crosslinkable preform after step (c).

8 Claims, 7 Drawing Sheets

METHOD FOR MAKING A POSITIVE TEMPERATURE COEFFICIENT DEVICE

BACKGROUND OF THE INVENTION

1. Field of the Invention

This invention relates to a method for making a positive temperature coefficient (PTC) device, more particularly to a method for making a PTC device that includes crosslinking a crosslinkable preform after soldering a pair of conductive leads to a pair of electrodes on the crosslinkable preform.

2. Description of the Related Art

A PTC composite material consisting of polymer and electrical conductive filler exhibits a PTC property such that the resistance of the PTC composite material is increased exponentially when the temperature thereof is raised to its melting point. Hence, the PTC composite material is commonly used as a fuse, such as a thermistor, for protecting a circuit from being damaged.

Referring to FIG. 1, a conventional method for making a PTC device 1 includes consecutive steps of: (A) sheeting a blend 11 of a PTC composition; (B) attaching a pair of electrodes 12 to the blend 11 of the PTC composition so as to sandwich the blend 11 of the PTC composition therebetween; (C) irradiating the blend 11 of the PTC composition so as to crosslink the same using an irradiating apparatus 17; and (D) soldering a pair of conductive leads 13 to the electrodes 12 using a lead-free solder paste 14 in a reflow oven 15 so as to form the PTC device 1.

Since the reflow oven 15 is required to be operated at a temperature sufficient to melt the lead-free solder paste 14 for the soldering operation, which is relatively high, undesired breaking of hydrogen bonds of the molecular structure of the crosslinked blend 11 of the PTC composition is likely to occur, which, in turn, results in a deviation from the specification in the resistance requirement for the products of the PTC device 1 and a reduction of the production yield.

In addition, the way of heating during the soldering of the leads 13 to the electrodes 12 in the reflow oven 15, i.e., by heating the upper one of the leads 13 through a heated gas blown from above and the lower one of the leads 13 through a metallic support 151 of the reflow oven 15 that is in contact therewith, can cause a non-uniform temperature distribution throughout the PTC device. As a consequence, when the PTC device is cooled down, the cooling rate throughout the crosslinked blend 11 of the PTC composition will be uneven, which results in an increase in the resistance of the crosslinked blend 11 of the PTC composition, which, in turn, results in an increase in power consumption during the use of the PTC device 1.

SUMMARY OF THE INVENTION

Therefore, the object of the present invention is to provide a method for making a positive temperature coefficient device that can eliminate the aforesaid drawbacks associated with the prior art.

According to this invention, there is provided a method for making a positive temperature coefficient device. The method comprises: (a) forming a crosslinkable preform of a positive temperature coefficient polymer composition containing a polymer system and a conductive filler; (b) attaching a pair of electrodes to the crosslinkable preform; (c) soldering a pair of conductive leads to the electrodes using a lead-free solder paste having a melting point greater than 210° C.; and (d) crosslinking the crosslinkable preform after step (c).

BRIEF DESCRIPTION OF THE DRAWING

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 1:
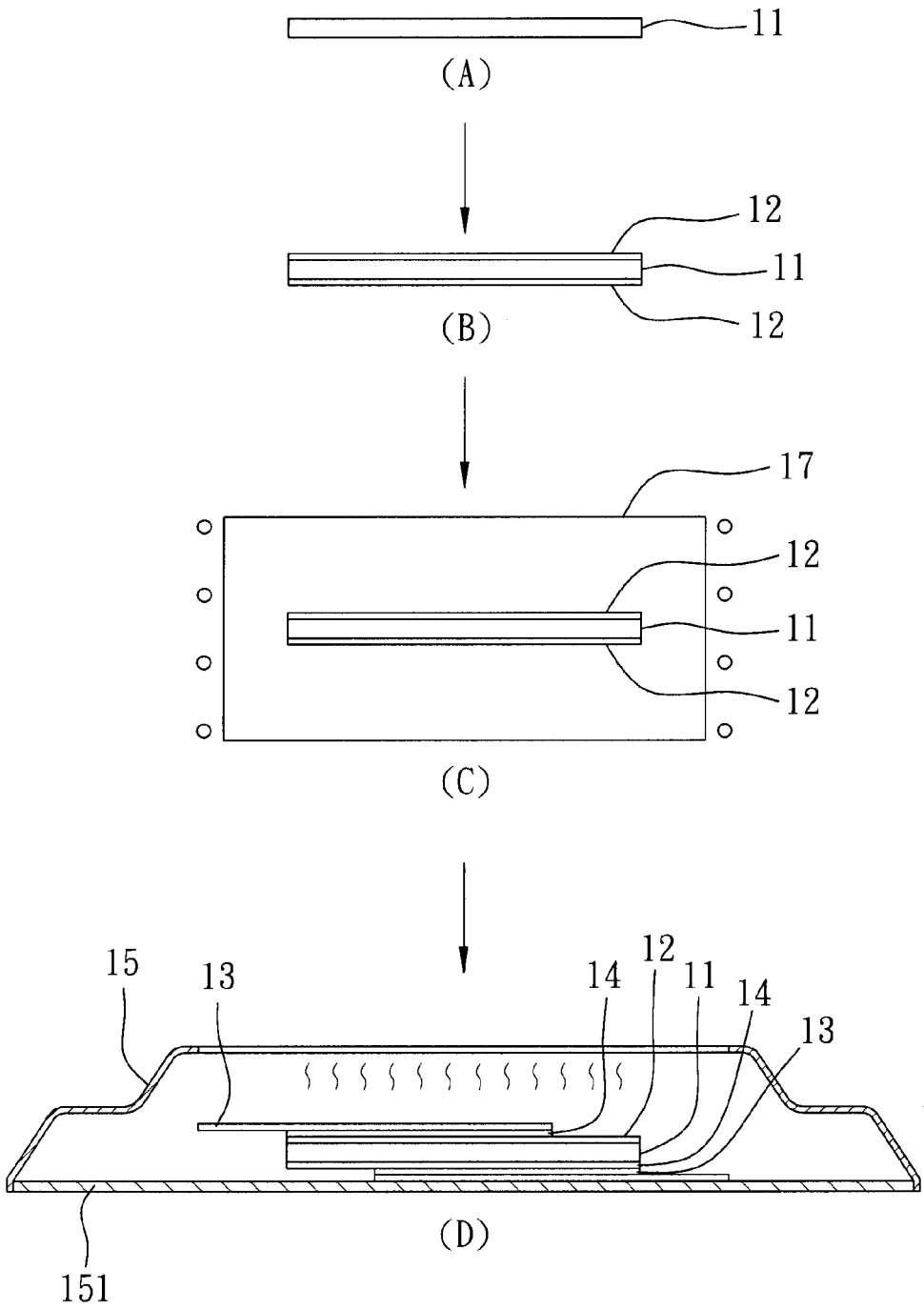
FIG. 1 PRIOR ART
FIG. 1 is a schematic diagram to illustrate consecutive steps of a conventional method for making a PTC device.

Before the present invention is described in greater detail with reference to the accompanying preferred embodiments, it should be noted herein that like elements are denoted by the same reference numerals throughout the disclosure.

Figure 2:
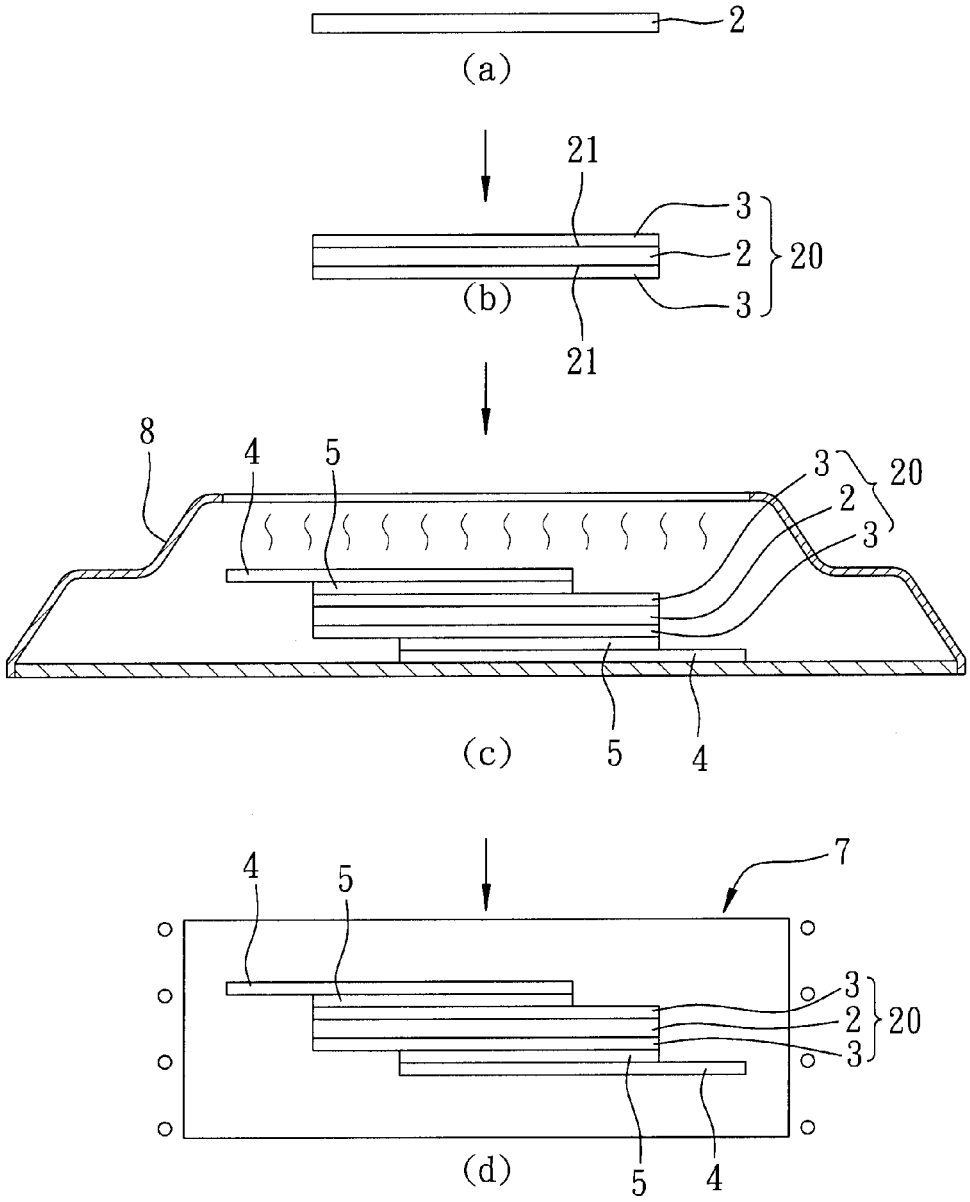
FIG. 2 is a schematic diagram to illustrate consecutive steps of the first preferred embodiment of a method for making a PTC device according to this invention.
Figure 3:
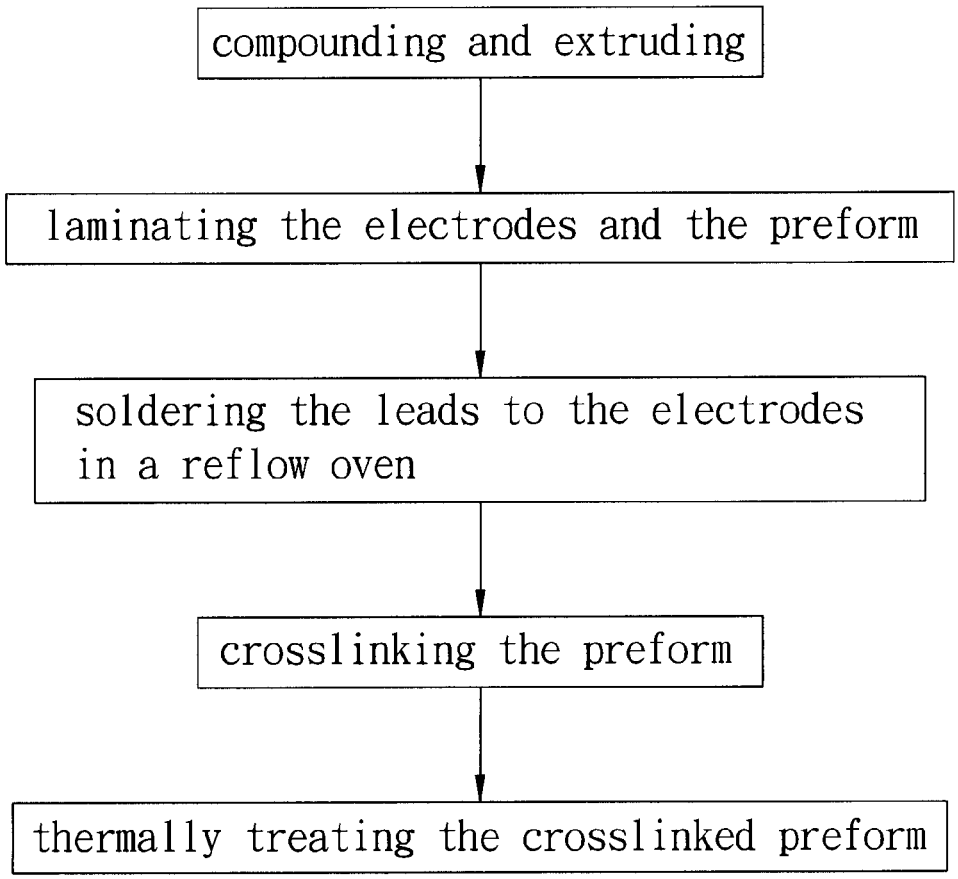
FIG. 3 is a flow chart to illustrate consecutive steps of the first preferred embodiment of the method for making the PTC device according to this invention.

FIG. 2 and FIG. 3 illustrate the first preferred embodiment of a method for making a PTC device according to this invention. The method includes the steps of: (a) forming a crosslinkable preform 2 of a positive temperature coefficient polymer composition containing a polymer system and a conductive filler; (b) attaching a pair of electrodes 3 to the crosslinkable preform 2; (c) soldering a pair of conductive leads 4 to the electrodes 3 using a lead-free solder paste 5 having a melting point greater than 210° C. through reflow soldering techniques; and (d) crosslinking the crosslinkable preform 2 after step (c) using irradiation techniques. In the first preferred embodiment, the soldering operation in step (c) is conducted using a reflow oven 8.

Preferably, the soldering operation in step (c) is conducted at a working temperature greater than the melting point of the lead-free solder paste 5 and not greater than 260° C. More preferably, the working temperature of the soldering operation in step (c) ranges from 240° C. to 260° C.

Preferably, the polymer system contains a crystalline polyolefin selected from the group consisting of non-grafted high density polyethylene (HDPE), non-grafted low density polyethylene (LDPE), non-grafted ultra-low density polyethylene (ULDPE), non-grafted middle density polyethylene (MDPE), non-grafted polypropylene (PP), and combinations thereof, and a copolymer of an olefin monomer and an anhydride monomer. For example, ethylene/maleic anhydride (PE/MA) copolymer and ethylene/butyl acrylate/maleic anhydride (PE/BA/MA) trimer can be used as the copolymer in this invention.

Preferably, the conductive filler is selected from the group consisting of carbon black, metal powder, such as Ni powder, and a combination thereof.

Preferably, the crosslinkable preform 2 is formed by compounding and extruding the positive temperature coefficient polymer composition. The electrodes 3 in step (b) are attached respectively to two opposite surfaces 21 of the crosslinkable preform 2 through laminating techniques so as to form a laminate 20.

Preferably, the first preferred embodiment further includes thermally treating the crosslinked preform 2 after step (d) (see FIG. 3) by iteratively repeating a process of heating the crosslinked preform 2 to a first working temperature ranging from 50° C. to 130° C. and then cooling the crosslinked preform 2 to a second working temperature ranging from −80° C. to 0° C. for a plurality of times.

Figure 4:
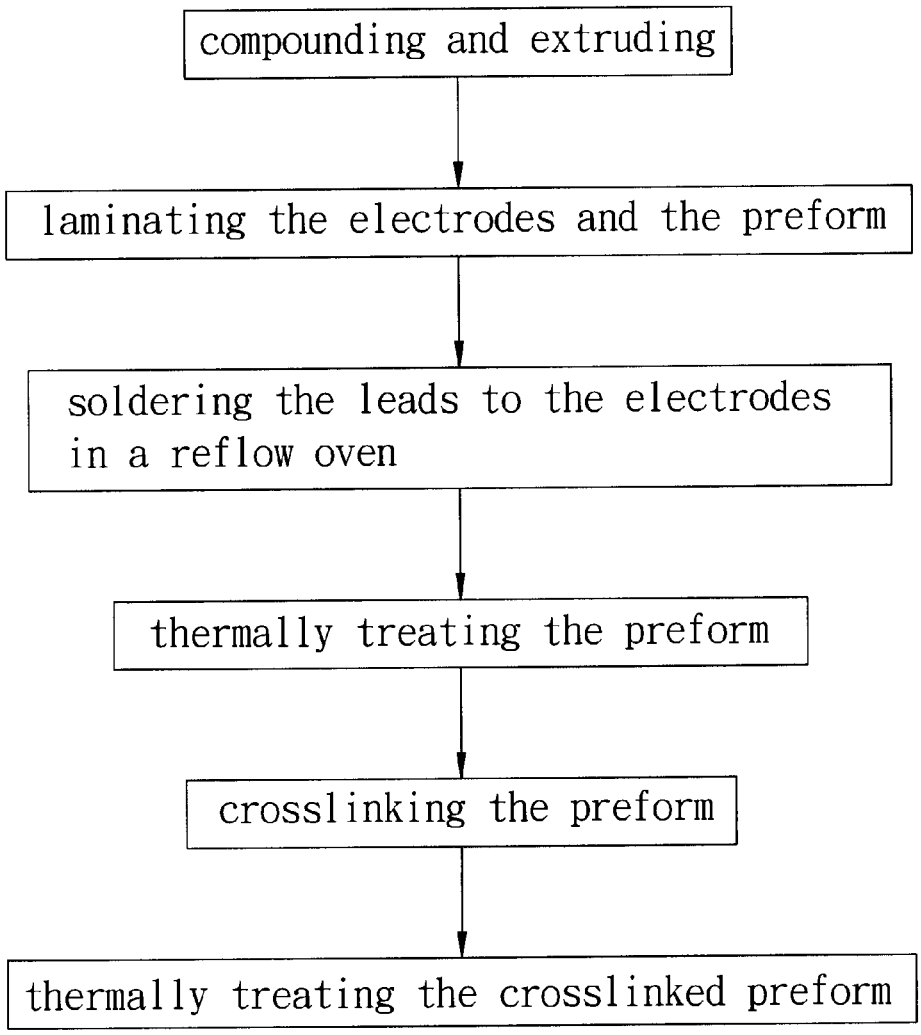
FIG. 4 is a flow chart to illustrate consecutive steps of the second preferred embodiment of the method for making a PTC device according to this invention.

FIG. 4 illustrates the second preferred embodiment of the method for making the PTC device according to this invention. The second preferred embodiment differs from the previous embodiment in that the second preferred embodiment further includes a step of thermally treating the crosslinkable preform 2 before step (d) by iteratively repeating the process of heating the crosslinkable preform 2 to the first working temperature and then cooling the crosslinkable preform 2 to the second working temperature for a plurality of times. Preferably, the thermal treatment process is repeated form 7 to 10 times.

Figure 5:
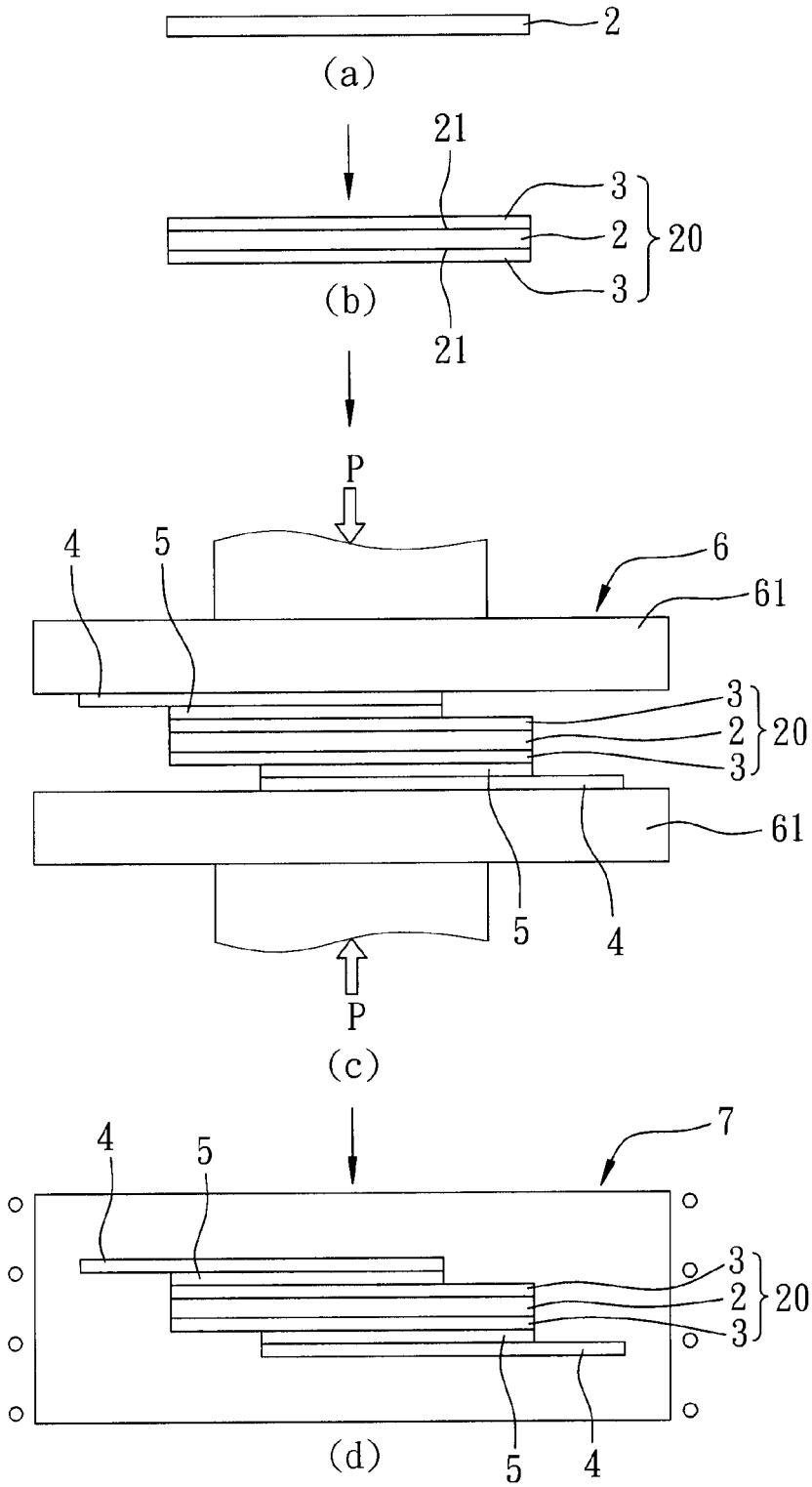
FIG. 5 is a schematic diagram to illustrate consecutive steps of the third preferred embodiment involving the use of a hot pressing machine for soldering conductive leads to electrodes of the PTC device of this invention.
Figure 6:
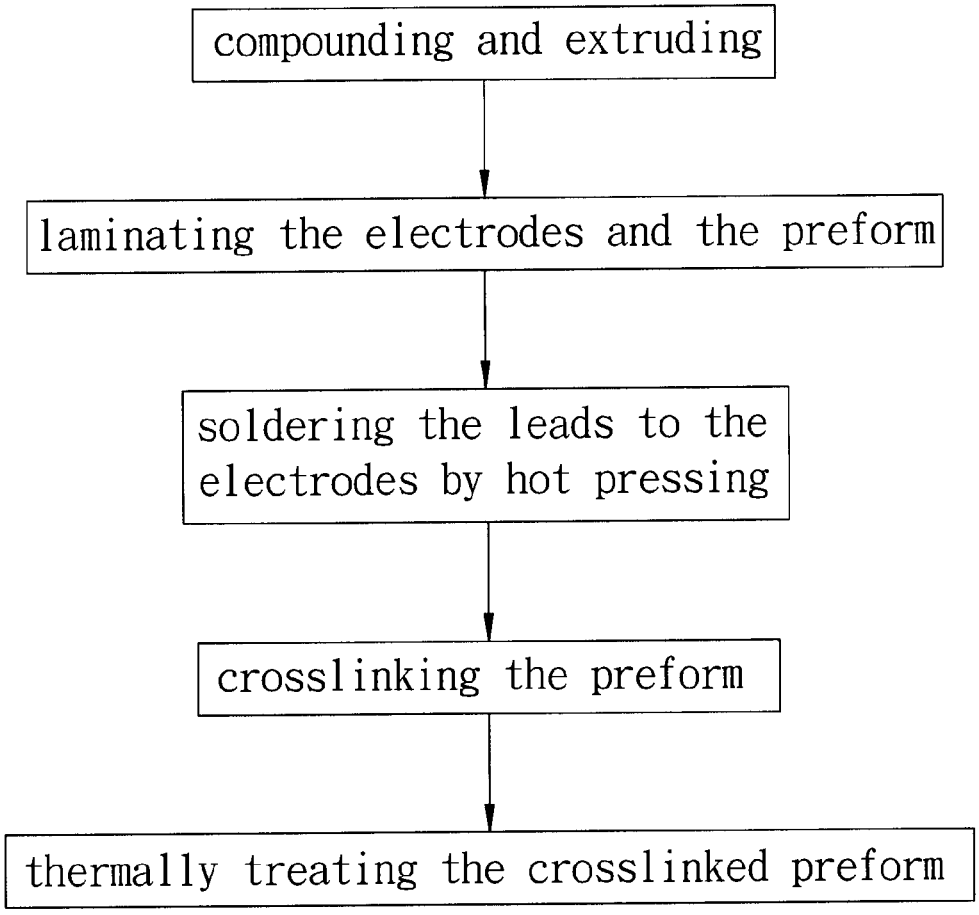
FIG. 6 is a flow chart to illustrate consecutive steps of the third preferred embodiment of the method for making the PTC device according to this invention.

FIG. 5 and FIG. 6 illustrate the third preferred embodiment of the method for making the PTC device according to this invention. The third preferred embodiment differs from the first preferred embodiment in that the laminate 20 together with the conductive leads 4 is hot pressed during the soldering operation in step (c) by applying a pressure P to the conductive leads 4 using a hot pressing machine 6. More preferably, the pressure P applied to the conductive leads 4 is not greater than 50 psi.

Figure 7:
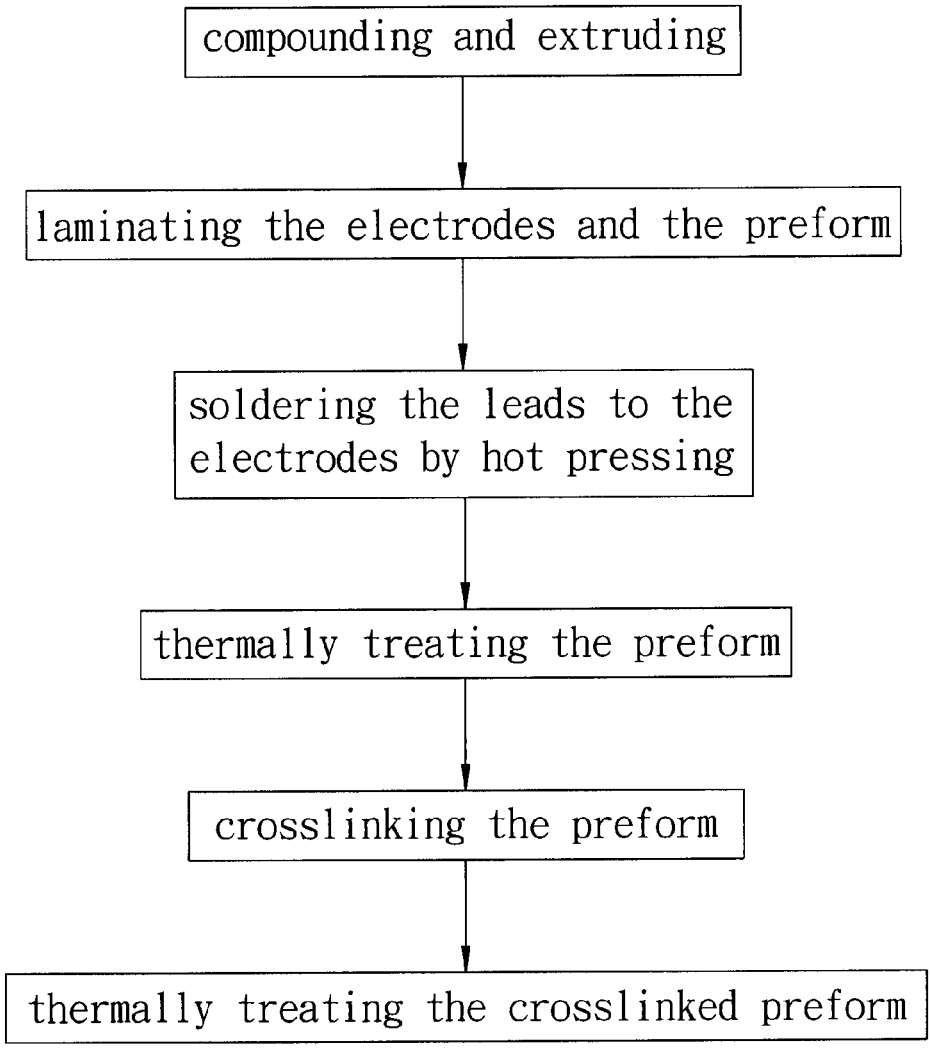
FIG. 7 is a flow chart to illustrate consecutive steps of the fourth preferred embodiment of the method for making the PTC device according to this invention.

FIG. 7 illustrates the fourth preferred embodiment of the method for making the PTC device according to this invention. The fourth preferred embodiment differs from the second preferred embodiment in that the soldering in step (c) is conducted through hot pressing techniques.

Preferably, the crosslinking operation in step (d) for the above preferred embodiments is conducted by irradiating the crosslinkable preform 2 to a dosage of at least 10 kGy using Cobalt-60 gamma-ray irradiation generated by an irradiating apparatus 7.

It is noted that the crosslinkable preform 2 can be partially crosslinked before the soldering operation to an extent that causes insignificant deviation from the specification in the resistance requirement of the products of the PTC device.

The merits of the method for making the PTC device of this invention will become apparent with reference to the following Examples and Comparative Examples.

Table 1 shows different PTC polymer compositions of six formulations (F1~F6) for preparing PTC materials of the following Examples and Comparative Examples.

TABLE 1

| Formu. | Crystalline polyolefin | Wt % | Copolymer | Wt % | Conductive filler | Wt % |
|---|---|---|---|---|---|---|
| F1 | HDPE8050[a] | 22.50 | MB100D[b] | 22.50 | Raven 430 UB[e] | 55.00 |
| F2 | HDPE8050 | 10.00 | MB100D | 10.00 | T-240 Ni powder[f] | 80.00 |
| F3 | HDPE8050 | 22.50 | Lotarder P3 3200[c] | 22.50 | Raven 430 UB | 55.00 |

TABLE 1-continued

| Formu. | Crystalline polyolefin | Wt % | Copolymer | Wt % | Conductive filler | Wt % |
|---|---|---|---|---|---|---|
| F4 | HDPE8050 | 10.00 | Lotarder P3 3200 | 10.00 | T-240 Ni powder | 80.00 |
| F5 | HDPE8050 | 22.50 | EC-603D[d] | 22.50 | Raven 430 UB | 55.00 |
| F6 | HDPE8050 | 10.00 | EC-603D | 10.00 | T-240 Ni powder | 80.00 |

[a]HDPE with a melting point ($T_m$) of 140° C., purchased from Formosa Plastic Corporation, Taiwan.
[b]PE/MA copolymer with a melting point of 132° C., purchased from Dupont.
[c]PE/BA/MA trimer with a melting point of 108° C., purchased from Arkema Incorporation.
[d]PE/MA copolymer with a melting point of 105° C., purchased from Dupont.
[e]a carbon powder purchased from Columbian Chemicals Company.
[f]a product purchased from Inco Special Products.

EXAMPLES

Example 1

E1

Six PTC materials, having different PTC polymer compositions (F1-F6) listed in Table 1, for Example 1 were prepared based on the method of the first preferred embodiment as illustrated in FIG. 2 and FIG. 3. Each of the PTC polymer compositions (F1-F6) was compounded and extruded so as to form the crosslinkable preform 2. Then, the electrodes 3 were attached respectively to the surfaces 21 of the crosslinkable preform 2 through laminating techniques so as to form the laminate 20 having a size of 5 mm×12 mm×0.3 mm. The conductive leads 4 were then soldered to the electrodes 3 by placing an assembly of the conductive leads 4 and the laminate 20 in the reflow oven 8 operated at a working temperature of 260° C. The assembly was subsequently subjected to 100 kGy of Cobalt-60 gamma-ray irradiation using the irradiating apparatus 7 for crosslinking. Finally, the assembly was subjected to a thermal treatment by iteratively repeating a process of heating and cooling the assembly for 10 times so as to form the PTC materials (E1/F1-F6) for Example 1. The heating and cooling process was conducted by heating the assembly to a first working temperature of 80° C., maintaining the current temperature for 30 minutes, cooling the assembly to a second working temperature of −40° C., and maintaining the current temperature for 30 minutes using a thermal shocker (not shown) that was purchased from Ten Billion Technology Corporation (TBST-B2). The resistances of the laminate 20 and the PTC device thus formed for each PTC material were measured.

Example 2

E2

Six PTC materials, having different PTC polymer compositions (F1-F6) listed in Table 1, for Example 2 were prepared based on the method of the second preferred embodiment as illustrated in FIG. 4. The procedures and operating conditions for preparing each PTC material were similar to those of Example 1 (E1), except that the assembly of the conductive leads 4 and the laminate 20 was subjected to thermal treatment prior to and after the crosslinking operation under operating conditions similar to those of Example 1.

Example 3

E3

Six PTC materials, having different PTC polymer compositions (F1-F6) listed in Table 1, for Example 3 were prepared based on the method of the third preferred embodiment as illustrated in FIG. 5 and FIG. 6. The procedures and operating conditions for preparing each PTC material were similar to those of Example 1 (E1), except that the conductive leads 4 were soldered to the electrodes 3 using the hot pressing machine 6. In Example 3, the pressure P applied to the conductive leads 4 was 50 psi for each PTC material.

Example 4

E4

Six PTC materials, having different PTC polymer compositions (F1-F6) listed in Table 1, for Example 4 were prepared based on the method of the fourth preferred embodiment as illustrated in FIG. 7. The procedures and operating conditions for preparing each PTC material were similar to those of Example 2 (E2), except that the conductive leads 4 were soldered to the electrodes 3 using the hot pressing machine 6. In Example 4, the pressure P applied to the conductive leads 4 was 50 psi for each PTC material.

Examples 5-8

E5-E8

Six PTC materials, having different PTC polymer compositions (F1-F6) listed in Table 1, for each of Examples 5-8 were prepared based on the method of the fourth preferred embodiment as illustrated in FIG. 7. The procedures and operating conditions for preparing each PTC material were similar to those of Example 4 (E4), except that the pressure P applied to the conductive leads 4 were 10 psi, 30 psi, 70 psi and 100 psi for Examples 5, 6, 7 and 8, respectively.

Comparative Example 1

CE1

Six PTC materials, having different PTC polymer compositions (F1-F6) listed in Table 1, for Comparative Example 1 were prepared. The procedures and operating conditions for preparing each PTC material were similar to those of Example 1 (E1), except that the crosslinking operation by irradiation was implemented before the soldering operation.

Comparative Example 2

CE2

Six PTC materials, having different PTC polymer compositions (F1-F6) listed in Table 1, for Comparative Example 2 were prepared. The procedures and operating conditions for preparing each PTC material were similar to those of Example 3 (E3), except that the crosslinking operation by irradiation was implemented before the soldering operation.

Table 2 shows the measured resistances and the resistance change in percentage (R %) of each PTC material for Comparative Examples (CE1-CE2) and Examples (E1-E4). The measured resistance of each PTC material in Table 2 is an average value of measured resistances of ten specimens obtained from the PTC material. The resistance change in percentage (R %) is defined as $(R_1/R_0)\times100\%$, wherein $R_0$ and $R_1$ represent the initial resistances of the laminate (before soldering) and the PTC device (after soldering) of each PTC material, respectively.

From the results shown in Table 2, the resistance changes of Examples (E1-E4) in percentage are much lower than Comparative Examples CE1 and CE2 under the same polymer composition or formulation. Moreover, since formation of the PTC devices of Examples 3 and 4 (E3-E4) involves the use of the hot pressing machine 6 during soldering operation, a uniform heating of the crosslinkable preform 2 can be achieved through the heating and pressing of two metallic plates 61 of the hot pressing machine 6 (see FIG. 5) on the conductive leads 4. As a consequence, the resistance change in percentage (R %) of each of Examples 3 and 4 (E3-E4) is lower than Examples 1 and 2 (E1-E2) under the same polymer composition or formulation.

TABLE 2

| | | Laminate | | | Device | | | |
|---|---|---|---|---|---|---|---|---|
| Exp. | Formu. | $R_0$ (Ω) | $A_1$ | $B_1$ (%) | $R_1$ (Ω) | $A_2$ | $B_2$ (%) | R (%) |
| CE1 | F1 | 0.00484 | 0.00037 | 7.72 | 0.02092 | 0.00499 | 23.84 | 432.29 |
| CE2 | F1 | 0.00494 | 0.00038 | 7.61 | 0.02040 | 0.00479 | 23.49 | 413.38 |
| E1 | F1 | 0.00508 | 0.00043 | 8.48 | 0.01271 | 0.00174 | 13.69 | 250.27 |
| E2 | F1 | 0.00484 | 0.00041 | 8.48 | 0.01115 | 0.00136 | 12.20 | 230.52 |
| E3 | F1 | 0.00504 | 0.00039 | 7.75 | 0.01072 | 0.00111 | 10.31 | 212.78 |
| E4 | F1 | 0.00494 | 0.00037 | 7.53 | 0.01030 | 0.00098 | 9.49 | 208.69 |
| CE1 | F2 | 0.00099 | 0.00023 | 22.81 | 0.01350 | 0.04036 | 298.89 | 1360.31 |
| CE2 | F2 | 0.00099 | 0.00023 | 22.90 | 0.01337 | 0.03894 | 291.21 | 1344.22 |
| E1 | F2 | 0.00093 | 0.00023 | 24.63 | 0.00797 | 0.01468 | 184.06 | 857.16 |
| E2 | F2 | 0.00095 | 0.00023 | 24.48 | 0.00706 | 0.01064 | 150.72 | 743.38 |
| E3 | F2 | 0.00097 | 0.00023 | 23.61 | 0.00685 | 0.00886 | 129.37 | 707.29 |
| E4 | F2 | 0.00096 | 0.00023 | 23.47 | 0.00665 | 0.00791 | 118.97 | 693.56 |
| CE1 | F3 | 0.00491 | 0.00037 | 7.46 | 0.01448 | 0.00278 | 19.21 | 295.18 |
| CE2 | F3 | 0.00493 | 0.00037 | 7.48 | 0.01384 | 0.00269 | 19.43 | 280.69 |
| E1 | F3 | 0.00488 | 0.00035 | 7.15 | 0.00855 | 0.00127 | 14.80 | 175.25 |
| E2 | F3 | 0.00498 | 0.00035 | 7.10 | 0.00757 | 0.00095 | 12.56 | 151.98 |
| E3 | F3 | 0.00491 | 0.00036 | 7.30 | 0.00735 | 0.00072 | 9.80 | 149.77 |
| E4 | F3 | 0.00501 | 0.00036 | 7.25 | 0.00713 | 0.00055 | 7.65 | 142.50 |
| CE1 | F4 | 0.00101 | 0.00020 | 20.32 | 0.00624 | 0.00687 | 110.23 | 618.74 |
| CE2 | F4 | 0.00101 | 0.00021 | 20.30 | 0.00651 | 0.00849 | 130.39 | 643.59 |
| E1 | F4 | 0.00101 | 0.00021 | 20.83 | 0.00361 | 0.00265 | 73.56 | 358.69 |
| E2 | F4 | 0.00100 | 0.00021 | 20.94 | 0.00313 | 0.00191 | 60.91 | 313.19 |

TABLE 2-continued

| | | Laminate | | | Device | | | |
|---|---|---|---|---|---|---|---|---|
| Exp. | Formu. | $R_0$ (Ω) | $A_1$ | $B_1$ (%) | $R_1$ (Ω) | $A_2$ | $B_2$ (%) | R (%) |
| E3 | F4 | 0.00103 | 0.00021 | 20.05 | 0.00310 | 0.00160 | 51.70 | 300.78 |
| E4 | F4 | 0.00103 | 0.00020 | 19.85 | 0.00307 | 0.00135 | 43.88 | 298.70 |
| CE1 | F5 | 0.00487 | 0.00035 | 7.22 | 0.01329 | 0.00228 | 17.18 | 273.01 |
| CE2 | F5 | 0.00492 | 0.00035 | 7.21 | 0.01355 | 0.00233 | 17.18 | 275.64 |
| E1 | F5 | 0.00491 | 0.00035 | 7.04 | 0.00912 | 0.00084 | 9.22 | 185.56 |
| E2 | F5 | 0.00506 | 0.00034 | 6.79 | 0.00707 | 0.00051 | 7.25 | 139.53 |
| E3 | F5 | 0.00492 | 0.00035 | 7.04 | 0.00680 | 0.00051 | 7.50 | 138.32 |
| E4 | F5 | 0.00497 | 0.00035 | 7.01 | 0.00655 | 0.00045 | 6.84 | 131.80 |
| CE1 | F6 | 0.00101 | 0.00020 | 19.67 | 0.00446 | 0.00365 | 81.75 | 443.91 |
| CE2 | F6 | 0.00102 | 0.00020 | 19.48 | 0.00435 | 0.00351 | 80.53 | 427.84 |
| E1 | F6 | 0.00100 | 0.00020 | 20.40 | 0.00256 | 0.00166 | 64.69 | 257.24 |
| E2 | F6 | 0.00102 | 0.00020 | 19.97 | 0.00243 | 0.00108 | 44.48 | 239.63 |
| E3 | F6 | 0.00100 | 0.00020 | 20.07 | 0.00231 | 0.00088 | 38.05 | 232.34 |
| E4 | F6 | 0.00099 | 0.00020 | 19.87 | 0.00220 | 0.00072 | 32.54 | 221.30 |

$A_1$ is the standard deviation of the initial resistance of the laminate.
$B_1$ is the coefficient of the variation of the initial resistance of the laminate.
$A_2$ is the standard deviation of the initial resistance of the PTC device.
$B_2$ is the coefficient of the variation of the initial resistance of the PTC device.

Table 3 shows the PTC effect test results for the PTC devices for Comparative Examples (CE1~CE2) and Examples (E1~E4). The measured resistance of each PTC material is an average value of measured resistances of ten specimens obtained from the PTC material. In the test, each PTC material was placed in a hot air oven, and was heated from 20 to 200° C. under a heating rate of 2° C./min. The measured resistances at 140° C. and 170° C. (see Table 3) were recorded using a data acquisition instrument (Agilent 34970A) with a scanning rate of 1 time/sec. A positive value of the resistance difference $R_{170}$-$R_{140}$ shown in Table 3 is an indication that the PTC device has the PTC effect at the temperature range, while a negative value of the resistance difference $R_{170}$-$R_{140}$ is an indication that the PTC device does not have or lost the PTC effect at the temperature range. In addition, the magnitude of the resistance difference $R_{170}$-$R_{140}$ must be sufficient to provide the PTC effect.

TABLE 3

| Exp. | Formu. | Avg. $R_1$ (Ω) | Avg. $R_{140}$ (Ω) | Avg. $R_{170}$ (Ω) | $R_{170} - R_{140}$ (Ω) |
|---|---|---|---|---|---|
| E1 | F1 | 0.01271 | 32983.13 | 93403.94 | 60420.81 |
| E1 | F2 | 0.00797 | 129532.43 | 356820.23 | 227287.80 |
| E1 | F3 | 0.00855 | 29354.99 | 90601.82 | 61246.84 |
| E1 | F4 | 0.00361 | 121760.48 | 335411.02 | 213650.53 |
| E1 | F5 | 0.00912 | 27887.24 | 85165.71 | 57278.48 |
| E1 | F6 | 0.00256 | 113237.25 | 318640.47 | 205403.22 |
| E2 | F1 | 0.01115 | 28444.98 | 83462.40 | 55017.42 |
| E2 | F2 | 0.00706 | 112104.88 | 334572.49 | 222467.61 |
| E2 | F3 | 0.00757 | 29298.33 | 89304.77 | 60006.44 |
| E2 | F4 | 0.00313 | 104257.54 | 327881.04 | 223623.50 |
| E2 | F5 | 0.00707 | 27833.41 | 91983.91 | 64150.50 |
| E2 | F6 | 0.00243 | 109470.41 | 426245.35 | 316774.94 |
| E3 | F1 | 0.01072 | 27555.08 | 89224.39 | 61669.31 |
| E3 | F2 | 0.00685 | 101807.48 | 404933.08 | 303125.60 |
| E3 | F3 | 0.00735 | 27003.98 | 92793.37 | 65789.39 |
| E3 | F4 | 0.00310 | 103843.63 | 489969.03 | 386125.40 |
| E3 | F5 | 0.00680 | 26463.90 | 89081.63 | 62617.73 |
| E3 | F6 | 0.00231 | 96574.58 | 465470.58 | 368896.00 |
| E4 | F1 | 0.01030 | 25934.62 | 88190.82 | 62256.20 |
| E4 | F2 | 0.00665 | 89814.36 | 442197.05 | 352382.69 |
| E4 | F3 | 0.00713 | 27231.35 | 91718.45 | 64487.10 |
| E4 | F4 | 0.00307 | 93406.93 | 433353.11 | 339946.18 |
| E4 | F5 | 0.00655 | 28592.92 | 92635.63 | 64042.71 |
| E4 | F6 | 0.00220 | 102747.63 | 424686.05 | 321938.42 |
| CE1 | F1 | 0.02092 | 6224.31 | 5291.45 | −932.86 |
| CE1 | F2 | 0.01350 | 18861.02 | 13265.91 | −5595.10 |
| CE1 | F3 | 0.01448 | 5718.58 | 5503.11 | −215.48 |

TABLE 3-continued

| Exp. | Formu. | Avg. $R_1$ (Ω) | Avg. $R_{140}$ (Ω) | Avg. $R_{170}$ (Ω) | $R_{170} - R_{140}$ (Ω) |
|---|---|---|---|---|---|
| CE1 | F4 | 0.00624 | 14011.04 | 17334.12 | 3323.08 |
| CE1 | F5 | 0.01329 | 5432.65 | 7410.85 | 1978.20 |
| CE1 | F6 | 0.00446 | 20549.53 | 21234.30 | 684.78 |
| CE2 | F1 | 0.02040 | 5913.09 | 4603.56 | −1309.53 |
| CE2 | F2 | 0.01337 | 17729.35 | 13663.89 | −4065.47 |
| CE2 | F3 | 0.01384 | 5838.67 | 5833.29 | −5.38 |
| CE2 | F4 | 0.00651 | 16112.70 | 18027.49 | 1914.79 |
| CE2 | F5 | 0.01355 | 6464.86 | 8003.72 | 1538.86 |
| CE2 | F6 | 0.00435 | 24659.43 | 22296.02 | −2363.41 |

From the results shown in Table 3, Examples (E1-E4) exhibit good PTC effect at the temperature range. Although the formulations F4-F6 of Comparative Example 1 and the formulations F4-F5 of Comparative Example 2 have positive values of the resistance difference $R_{170}$-$R_{140}$, the magnitudes thereof are insufficient for providing the PTC effect at the temperature range.

Table 4 shows the cycle test results under DC voltage for Comparative Examples (CE1~CE2) and Examples (E1~E4). The measured resistance change in percentage (R %) of each PTC material in Table 4 is an average value of ten specimens obtained from the PTC material. The cycle test was conducted according to the endurance test of UL1434 (having test conditions: 20 $V_{DC}$, 100 A, 100 cycles, each cycle including a power-on operation for 1 minute and a power-off operation for 1 minute).

The resistance change in percentage (R %) shown in Table 4 is defined as $(R_{100}/R_1)\times100\%$, wherein $R_1$ and $R_{100}$ represent resistances measured at initial and the $100^{th}$ cycle for the PTC material of the PTC device, respectively.

TABLE 4

| Exp. | Formu. | Cycle times | R (%) | Result |
|---|---|---|---|---|
| E1 | F1 | 100.0 | 367.87 | Pass |
| E1 | F2 | 100.0 | 884.32 | Pass |
| E1 | F3 | 100.0 | 204.61 | Pass |
| E1 | F4 | 100.0 | 753.34 | Pass |
| E1 | F5 | 100.0 | 209.00 | Pass |
| E1 | F6 | 100.0 | 1072.61 | Pass |
| E2 | F1 | 100.0 | 331.08 | Pass |
| E2 | F2 | 100.0 | 822.42 | Pass |

TABLE 4-continued

| Exp. | Formu. | Cycle times | R (%) | Result |
|---|---|---|---|---|
| E2 | F3 | 100.0 | 188.24 | Pass |
| E2 | F4 | 100.0 | 723.20 | Pass |
| E2 | F5 | 100.0 | 196.46 | Pass |
| E2 | F6 | 100.0 | 997.52 | Pass |
| E3 | F1 | 100.0 | 304.60 | Pass |
| E3 | F2 | 100.0 | 764.85 | Pass |
| E3 | F3 | 100.0 | 173.18 | Pass |
| E3 | F4 | 100.0 | 694.28 | Pass |
| E3 | F5 | 100.0 | 184.67 | Pass |
| E3 | F6 | 100.0 | 897.77 | Pass |
| E4 | F1 | 100.0 | 286.32 | Pass |
| E4 | F2 | 100.0 | 711.31 | Pass |
| E4 | F3 | 100.0 | 167.98 | Pass |
| E4 | F4 | 100.0 | 666.50 | Pass |
| E4 | F5 | 100.0 | 173.59 | Pass |
| E4 | F6 | 100.0 | 834.93 | Pass |
| CE1 | F1 | 100.0 | 459.84 | Pass |
| CE1 | F2 | 38.5 | — | Failed |
| CE1 | F3 | 100.0 | 249.52 | Pass |
| CE1 | F4 | 100.0 | 1158.98 | Pass |
| CE1 | F5 | 100.0 | 298.57 | Pass |
| CE1 | F6 | 100.0 | 1849.32 | Pass |
| CE2 | F1 | 100.0 | 433.58 | Pass |
| CE2 | F2 | 40.2 | — | Failed |
| CE2 | F3 | 100.0 | 247.34 | Pass |
| CE2 | F4 | 100.0 | 1093.23 | Pass |
| CE2 | F5 | 100.0 | 279.56 | Pass |
| CE2 | F6 | 100.0 | 1744.92 | Pass |

From the results shown in Table 4, all of the PTC materials of Examples E1-E4 passed the cycle test under DC voltage, while not all of the samples of Comparative Examples CE1 and CE2 passed the cycle test.

Table 5 shows the cycle test results under AC voltage for Comparative Examples (CE1~CE2) and Examples (E1~E4). The measured resistance change in percentage of each PTC material in Table 5 is an average value of ten specimens obtained from the PTC material. The cycle test shown in Table 5 was conducted according to the endurance test of UL1434 (having test conditions: 30 $V_{rms}$, 10 A, 50 cycles, each cycle including a power-on operation for 1 minute and a power-off operation for 1 minute).

The resistance change in percentage (R %) shown in Table 5 is defined as $(R_{50}/R_1)\times 100\%$, wherein $R_1$ and $R_{50}$ represent resistances measured at initial and the $50^{th}$ cycle for the PTC material of the PTC device, respectively.

TABLE 5

| Exp. | Formu. | Cycle times | R (%) | Result |
|---|---|---|---|---|
| E1 | F1 | 50.0 | 687.92 | Pass |
| E1 | F2 | 50.0 | 1644.84 | Pass |
| E1 | F3 | 50.0 | 378.52 | Pass |
| E1 | F4 | 50.0 | 1423.81 | Pass |
| E1 | F5 | 50.0 | 384.56 | Pass |
| E1 | F6 | 50.0 | 2016.50 | Pass |
| E2 | F1 | 50.0 | 667.28 | Pass |
| E2 | F2 | 50.0 | 1628.39 | Pass |
| E2 | F3 | 50.0 | 370.95 | Pass |
| E2 | F4 | 50.0 | 1393.91 | Pass |
| E2 | F5 | 50.0 | 374.56 | Pass |
| E2 | F6 | 50.0 | 1968.10 | Pass |
| E3 | F1 | 50.0 | 640.59 | Pass |
| E3 | F2 | 50.0 | 1573.02 | Pass |
| E3 | F3 | 50.0 | 357.97 | Pass |
| E3 | F4 | 50.0 | 1349.30 | Pass |
| E3 | F5 | 50.0 | 360.33 | Pass |
| E3 | F6 | 50.0 | 1891.35 | Pass |
| E4 | F1 | 50.0 | 608.56 | Pass |
| E4 | F2 | 50.0 | 1508.53 | Pass |
| E4 | F3 | 50.0 | 342.58 | Pass |

TABLE 5-continued

| Exp. | Formu. | Cycle times | R (%) | Result |
|---|---|---|---|---|
| E4 | F4 | 50.0 | 1292.63 | Pass |
| E4 | F5 | 50.0 | 343.39 | Pass |
| E4 | F6 | 50.0 | 1798.67 | Pass |
| CE1 | F1 | 8.1 | — | Failed |
| CE1 | F2 | 0.0 | — | Failed |
| CE1 | F3 | 43.4 | — | Failed |
| CE1 | F4 | 23.6 | — | Failed |
| CE1 | F5 | 41.3 | — | Failed |
| CE1 | F6 | 29.4 | — | Failed |
| CE2 | F1 | 8.5 | — | Failed |
| CE2 | F2 | 0.1 | — | Failed |
| CE2 | F3 | 44.7 | — | Failed |
| CE2 | F4 | 31.6 | — | Failed |
| CE2 | F5 | 45.6 | — | Failed |
| CE2 | F6 | 30.8 | — | Failed |

From the results shown in Table 5, all of the PTC materials of Examples E1-E4 passed the cycle test under AC voltage, while none of the PTC materials of Comparative Examples CE1 and CE2 passed the cycle test.

Table 6 shows the thermal runaway test results for Comparative Examples (CE1~CE2) and Examples (E1~E4). The failure voltage of each Example or Comparative Example in Table 6 is an average voltage of ten specimens. The thermal runaway test was conducted according to the thermal runaway test of UL1434 (having test conditions: the applied voltage being increased stepwise from an initial voltage of 10 $V_{DC}$ to a final voltage of 90 $V_{DC}$ under a fixed current of 5 A sufficient to cause the test specimen to trip at the initial applied voltage, in which the applied voltage is raised at increments of 10 $V_{DC}$ per step, the time interval between two steps is two minutes, and the time interval at each step is two minutes).

TABLE 6

| Exp. | Formu. | Failure Voltage (V) | Samples passing the test (%) |
|---|---|---|---|
| E1 | F1 | 90 | 90.0 |
| E1 | F2 | 80 | 90.0 |
| E1 | F3 | >90 | 100.0 |
| E1 | F4 | >90 | 100.0 |
| E1 | F5 | >90 | 100.0 |
| E1 | F6 | >90 | 100.0 |
| E2 | F1 | 80 | 80.0 |
| E2 | F2 | 80 | 90.0 |
| E2 | F3 | >90 | 100.0 |
| E2 | F4 | >90 | 100.0 |
| E2 | F5 | >90 | 100.0 |
| E2 | F6 | >90 | 100.0 |
| E3 | F1 | 90 | 90.0 |
| E3 | F2 | 90 | 90.0 |
| E3 | F3 | >90 | 100.0 |
| E3 | F4 | >90 | 100.0 |
| E3 | F5 | >90 | 100.0 |
| E3 | F6 | >90 | 100.0 |
| E4 | F1 | 90 | 90.0 |
| E4 | F2 | 90 | 90.0 |
| E4 | F3 | >90 | 100.0 |
| E4 | F4 | >90 | 100.0 |
| E4 | F5 | >90 | 100.0 |
| E4 | F6 | >90 | 100.0 |
| CE1 | F1 | 60 | 0.0 |
| CE1 | F2 | 40 | 0.0 |
| CE1 | F3 | 90 | 50.0 |
| CE1 | F4 | 70 | 30.0 |
| CE1 | F5 | 90 | 60.0 |
| CE1 | F6 | 70 | 40.0 |
| CE2 | F1 | 60 | 0.0 |
| CE2 | F2 | 50 | 0.0 |
| CE2 | F3 | 90 | 60.0 |

TABLE 6-continued

| Exp. | Formu. | Failure Voltage (V) | Samples passing the test (%) |
|---|---|---|---|
| CE2 | F4 | 70 | 40.0 |
| CE2 | F5 | 90 | 60.0 |
| CE2 | F6 | 70 | 50.0 |

From the results shown in Table 6, most of the PTC materials of Examples E1-E4 passed the thermal runaway test, while none of the PTC materials of Comparative Examples CE1 and CE2 passed the test.

Similar to Table 2, Table 7 shows the measured resistances and the resistance change in percentage (R %) of each PTC material for Examples E5-E8.

TABLE 7

| | | P | Laminate | | | Device | | | |
|---|---|---|---|---|---|---|---|---|---|
| Exp. | Formu. | (psi) | $R_0$ (Ω) | $A_1$ | $B_1$ (%) | $R_1$ (Ω) | $A_2$ | $B_2$ (%) | R (%) |
| E5 | F3 | 10 | 0.00503 | 0.00037 | 7.32 | 0.00723 | 0.00064 | 8.90 | 143.78 |
| E6 | F3 | 30 | 0.00500 | 0.00036 | 7.18 | 0.00723 | 0.00056 | 7.80 | 144.51 |
| E7 | F3 | 70 | 0.00499 | 0.00035 | 7.09 | 0.00920 | 0.00144 | 15.65 | 184.29 |
| E8 | F3 | 100 | 0.00499 | 0.00037 | 7.34 | 0.01027 | 0.00154 | 15.02 | 205.69 |
| E5 | F4 | 10 | 0.00101 | 0.00020 | 20.15 | 0.00307 | 0.00151 | 49.11 | 304.98 |
| E6 | F4 | 30 | 0.00103 | 0.00021 | 20.74 | 0.00308 | 0.00148 | 48.19 | 297.66 |
| E7 | F4 | 70 | 0.00101 | 0.00022 | 21.88 | 0.00323 | 0.00341 | 105.52 | 320.65 |
| E8 | F4 | 100 | 0.00102 | 0.00020 | 20.01 | 0.00378 | 0.00310 | 82.04 | 371.19 |

It is found from the results of Examples 2 and 4 (E2 and E4) shown in Table 2 and the results of Examples 5-8 (E5-E8) shown in Table 7 (note that no pressure was applied to the assembly during soldering for preparation of the PTC device of E2, while the pressure P applied to the assemblies of E4-E8 was 50 psi, 10 psi, 30 psi, 70 psi, and 100 psi, respectively) that the PTC device can achieve a lower resistance when a suitable pressure, ranging from 10-50 psi, is applied to the assembly during the soldering operation, and that the resistance of the PTC device is significantly increased when the pressure applied to the assembly is higher than 50 psi.

In conclusion, by crosslinking the crosslinkable preform 2 after soldering the conductive leads 3 to the electrodes 4 on the crosslinkable preform 2 in the method of this invention for making the PTC device, the PTC device is able to have a lower and stable resistance, a lower power consumption during the use thereof, and a high production yield.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A method for making a positive temperature coefficient device, comprising:

(a) first forming a crosslinkable preform of a positive temperature coefficient polymer composition containing a polymer system and a conductive filler;

(b) then attaching a pair of electrodes to the crosslinkable preform;

(c) next soldering and hot pressing a pair of conductive leads to the electrodes using a lead-free solder paste having a melting point greater than 210° C. in a hot pressing machine;

(d) next crosslinking the crosslinkable preform after step (c); and then (e) thermally treating the crosslinked preform after step (d) by iteratively repeating the process of heating the crosslinked preform to the first working temperature and then cooling the crosslinked preform to the second working temperature for a plurality of times, wherein soldering and hot pressing the conductive leads to the electrodes is conducted by applying a pressure to the conductive leads that ranges from 10 psi to 50 psi.

2. The method of claim 1, wherein the soldering in step (c) is conducted at a working temperature greater than the melting point of the lead-free solder paste and not greater than 260° C.

3. The method of claim 2, wherein the working temperature of the soldering in step (c) ranges from 240° C. to 260° C.

4. The method of claim 3, wherein the polymer system contains a crystalline polyolefin selected from the group consisting of non-grafted high density polyethylene, non-grafted low density polyethylene, non-grafted ultra-low density polyethylene, non-grafted middle density polyethylene, non-grafted polypropylene, and combinations thereof, and a copolymer of an olefin monomer and an anhydride monomer.

5. The method of claim 4, wherein the conductive filler is selected from the group consisting of carbon black, metal powder, and a combination thereof.

6. The method of claim 4, wherein the crosslinkable preform is formed by compounding and extruding the positive temperature coefficient polymer composition, the electrodes being attached respectively to two opposite surfaces of the crosslinkable preform through laminating techniques so as to form a laminate in step (b).

7. The method of claim 4, further comprising thermally treating the crosslinkable preform before step (d) by iteratively repeating a process of heating the crosslinkable preform to a first working temperature ranging from 50° C. to 130° C. and then cooling the crosslinkable preform to a second working temperature ranging from −80° C. to 0° C. for a plurality of times.

8. The method of claim 1, wherein the crosslinking operation in step (d) is conducted by irradiating the crosslinkable preform to a dosage of at least 10 kGy using Cobalt-60 gamma-ray irradiation.

* * * * *